US009303487B2

(12) United States Patent
Wilamowitz et al.

(10) Patent No.: US 9,303,487 B2
(45) Date of Patent: Apr. 5, 2016

(54) HEAT TREATMENT FOR REMOVAL OF BAUSCHINGER EFFECT OR TO ACCELERATE CEMENT CURING

(75) Inventors: Elisabeth Wilamowitz, Moncorneil-Grazan (FR); Joerg Lehr, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 912 days.

(21) Appl. No.: 13/460,199

(22) Filed: Apr. 30, 2012

(65) Prior Publication Data

US 2013/0284442 A1 Oct. 31, 2013

(51) Int. Cl.
*E21B 36/00* (2006.01)
*E21B 33/00* (2006.01)
*E21B 33/14* (2006.01)

(52) U.S. Cl.
CPC ..... *E21B 36/00* (2013.01); *E21B 33/14* (2013.01); *E21B 36/008* (2013.01)

(58) Field of Classification Search
CPC ..... E21B 49/006; E21B 36/00; E21B 33/14; E21B 36/008; C21D 9/08
USPC ..... 166/285, 302
See application file for complete search history.

(56) References Cited

U.S. PATENT DOCUMENTS

| | | | | |
|---|---|---|---|---|
| 2,843,512 | A | 7/1958 | Lodge | |
| 4,755,230 | A | 7/1988 | Ashton et al. | |
| 4,772,771 | A | 9/1988 | Murayama et al. | |
| 5,484,488 | A | 1/1996 | Hart et al. | |
| 7,459,033 | B2 | 12/2008 | Asahi et al. | |
| 7,575,060 | B2 | 8/2009 | Hillis et al. | |
| 7,818,986 | B1 | 10/2010 | Parker et al. | |
| 7,892,368 | B2 | 2/2011 | Tsuru et al. | |
| 7,967,926 | B2 | 6/2011 | Tsuru et al. | |
| 2005/0178456 | A1 | 8/2005 | Tsuru et al. | |
| 2005/0194190 | A1 | 9/2005 | Becker et al. | |
| 2005/0217768 | A1 | 10/2005 | Asahi et al. | |
| 2008/0286504 | A1 | 11/2008 | Asahi et al. | |
| 2009/0092514 | A1 | 4/2009 | Asahi et al. | |
| 2009/0320965 | A1 | 12/2009 | Tsuru et al. | |
| 2010/0038076 | A1 | 2/2010 | Spray et al. | |
| 2010/0119860 | A1 | 5/2010 | Hitoshi et al. | |
| 2010/0206570 | A1 | 8/2010 | Ocampos et al. | |
| 2011/0114323 | A1 | 5/2011 | Jennings et al. | |
| 2011/0114336 | A1 | 5/2011 | Lehr et al. | |
| 2012/0145409 | A1 * | 6/2012 | Nobileau | 166/380 |

FOREIGN PATENT DOCUMENTS

| | | |
|---|---|---|
| WO | 2006014333 | 2/2006 |

* cited by examiner

*Primary Examiner* — Kenneth L Thompson
*Assistant Examiner* — Michael Wills, III
(74) *Attorney, Agent, or Firm* — Steve Rosenblatt

(57) ABSTRACT

Materials are delivered within an expanded string before the string is subsequently compressively loaded such that the heat given off by the reaction of the delivered materials raises the fluid temperature in the recently expanded string to temperatures in a range of about 150-300 degrees Centigrade. The materials can be separated for delivery and then allowed to contact to initiate the reaction. Alternatively the materials can be delivered in separate conveyances for more immediate start of the exothermic reaction at the needed location or locations. To the extent there is curing cement about the expanded tubular, then the heat generated also reduces curing time to full setup of the sealing material. The applied heat counteracts or eliminates the Bauschinger effect.

23 Claims, 6 Drawing Sheets

HEAT TREATMENT FOR REMOVAL OF BAUSCHINGER EFFECT OR TO ACCELERATE CEMENT CURING

FIELD OF THE INVENTION

The field of the invention is to heat treat a tubular string that has been expanded so that it retains as much as possible its original compressive yield strength and modulus of elasticity as it had prior to expansion with an additional benefit of accelerating curing of cement or other seal material around the expanded tubular.

BACKGROUND OF THE INVENTION

The Bauschinger Effect describes material weakening due to plastic deformation followed by load reversal. In expanded casings, this occurs when the casing is first expanded and when later during operation of the well the pressure comes from the outside (formation pressure, pressing salt formations or other). Expansion creates tensile stress in a circumferential direction, whereas the outside pressure which the casing has to withstand during operation of the well creates compressive stress in the circumferential direction. This is the nature of the load reversal on the tubular after expansion as compared to during expansion. The expanded casing or tubular loses up to 30% or more in compressive yield strength and up to 20% or more in modulus of elasticity (or E-Mod.). The Bauschinger Effect can be compensated with heat treatment at temperatures of 150 to about 300° C. or more for several hours. Bauschinger Effect compensation results in the expanded tubular material regaining some of its initial compressive yield strength and E-Mod. Full Bauschinger compensation means that the material regains its strength and elasticity as they were before the expansion.

The present invention uses an exothermic chemical reaction between one liquid and another substance which may be fluid or solid or other material. The reactants can be pumped into the borehole where they react and create heat. Long casing sections can be treated at the same time. Keeping the reactants apart from one another prior to the reaction may be done in different ways, including but not limited to, pumping two fluid columns separated by a spacer fluid. The heat which is created by this reaction can be used to compensate the Bauschinger Effect. The heat can also be used to aid and speed up cement curing. Faster cement curing maybe of interest in any kind of cemented tubular, whereas Bauschinger Effect compensation is only of interest in expandable tubulars. The minimum temperature for Bauschinger Effect Compensation is between about 150 and about 300° C.

US Publication 2011/0114323A1 teaches chemical exothermic reactions for treatment of oilfield deposits. The patent application describes reactions which reach temperatures up to 245° C. In general chemical reactants and procedures which are used for removal of oilfield deposit may be applicable to compensation the Bauschinger Effect as well. Other references relating to using exothermic reactions to remove paraffin deposits are U.S. Pat. Nos. 4,755,230 and 5,484,488.

In other contexts, references that address the Bauschinger effect in pipe manufacturing for downhole applications are:

- US Publication 20080286504 Steel Plate or Steel Pipe with Small Occurrence of Bauschinger Effect and Methods of Production of Same;
- U.S. Pat. No. 7,818,986 Multiple Autofrettage; U.S. Pat. No. 7,459,033 Oil Country Tubular Goods Excellent in Collapse Characteristics After Expansion and Method of Production Thereof;

- US20050217768 Oil Country Tubular Goods Excellent in Collapse Characteristics After Expansion and Method of Production Thereof;
- US Publication 20090320965 UOE Steel Pipe Excellent in Collapse Strength and Method of Production Thereof;
- U.S. Pat. No. 7,967,926 UOE Steel Pipe Excellent in Collapse Strength and Method of Production Thereof;
- U.S. Pat. No. 7,892,368 UOE Steel Pipe Excellent in Collapse Strength and Method of Production Thereof;
- US Publication 20050178456 UOE Steel Pipe with Excellent Crash Resistance, and Method Of Manufacturing the UOE Steel Pipe;
- U.S. Pat. No. 7,575,060 Collapse Resistance of Tubing;
- U.S. Pat. No. 4,772,771 Method for the Production of High Strength Electric Seam Welded Oil-Well Pipe;
- US Publication 20100119860 Steel Pipe Excellent in Deformation Characteristics and Method of Producing the Same;
- US Publication 20090092514 Steel Pipe for High Strength Line Pipe Superior in Strain Aging Resistance and Steel Plate for High Strength Line Pipe and Methods Of Production of the Same;
- US Publication 20100038076 Expandable Tubulars for Use in Geologic Structures.

What is needed and provided by the present invention is a way to counteract the Bauschinger effect after the tubular sting is expanded in the subterranean location and preferably before the string is compressively loaded. Another advantage of the present invention can be the acceleration of the curing time for cement or other temperature sensitive material for curing whether the sealant is placed before or after tubular expansion. In the preferred embodiment an exothermic chemical reaction is made to occur within the expanded tubular while the expanded tubular wall is protected from differential loading that causes compressive stress in the tubular wall. This stress management can be accomplished with variation of mud densities within the expanded string. Reactants can be delivered while separated with a buffer fluid or another barrier that degrades or disappears over time. The exothermic nature of the reaction raises the tubular temperature for a sufficient time and to a required temperature so that the tubular material regains its yield strength lost in the expansion or a portion thereof as well as its modulus of elasticity. If cement or other sealant has been placed in the wellbore about the expanded tubular, either before or after the expansion, the heat generated also accelerates the curing time of the cement used in either a single wall or dual wall strings. Those skilled in the art will more readily appreciate these and other aspects of the present invention by a review of the detailed description of the preferred embodiment with the associated drawings while appreciating that the full scope of the invention is to be determined from the appended claims.

SUMMARY OF THE INVENTION

Materials are delivered within an expanded string before the string is subsequently compressively loaded such that the heat given off by the reaction of the delivered materials raises the fluid temperature in the recently expanded string to temperatures in a range of about 150-300 degrees Centigrade. The materials can be separated for delivery and then allowed to contact to initiate the reaction. Alternatively the materials can be delivered in separate conveyances for more immediate start of the exothermic reaction at the needed location or locations. To the extent there is curing cement about the expanded tubular, then the heat generated also reduces curing time to full setup of the sealing material. The applied heat counteracts or eliminates the Bauschinger effect.

BRIEF DESCRIPTION OF THE DRAWINGS

FIGS. 20-25 are similar to FIGS. 14-19 with the difference being that the expanded tubular is multi-wall with cement in between.

DETAILED DESCRIPTION OF THE PREFERRED EMBODIMENT

Figure 3:
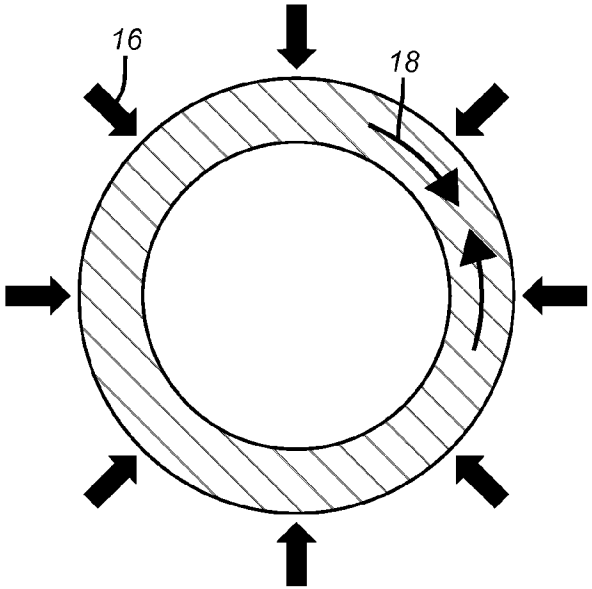
FIG. 3 is a section view showing the compressive forces on the tubular from formation fluids after expansion.
Figure 2:
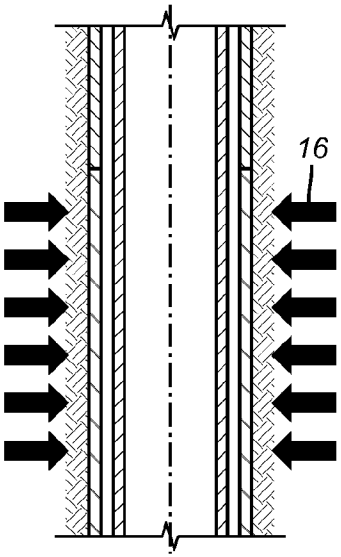
FIG. 2 shows compressive loading from formation fluids on the expanded tubular.
Figure 1:
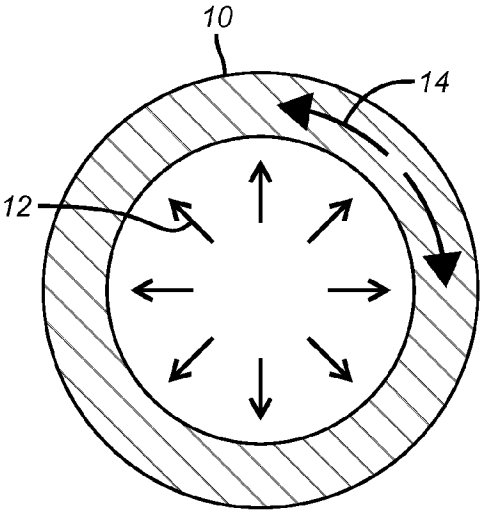
FIG. 1 is a section view of a tubular being expanded with the wall in tension.
Figure 4:
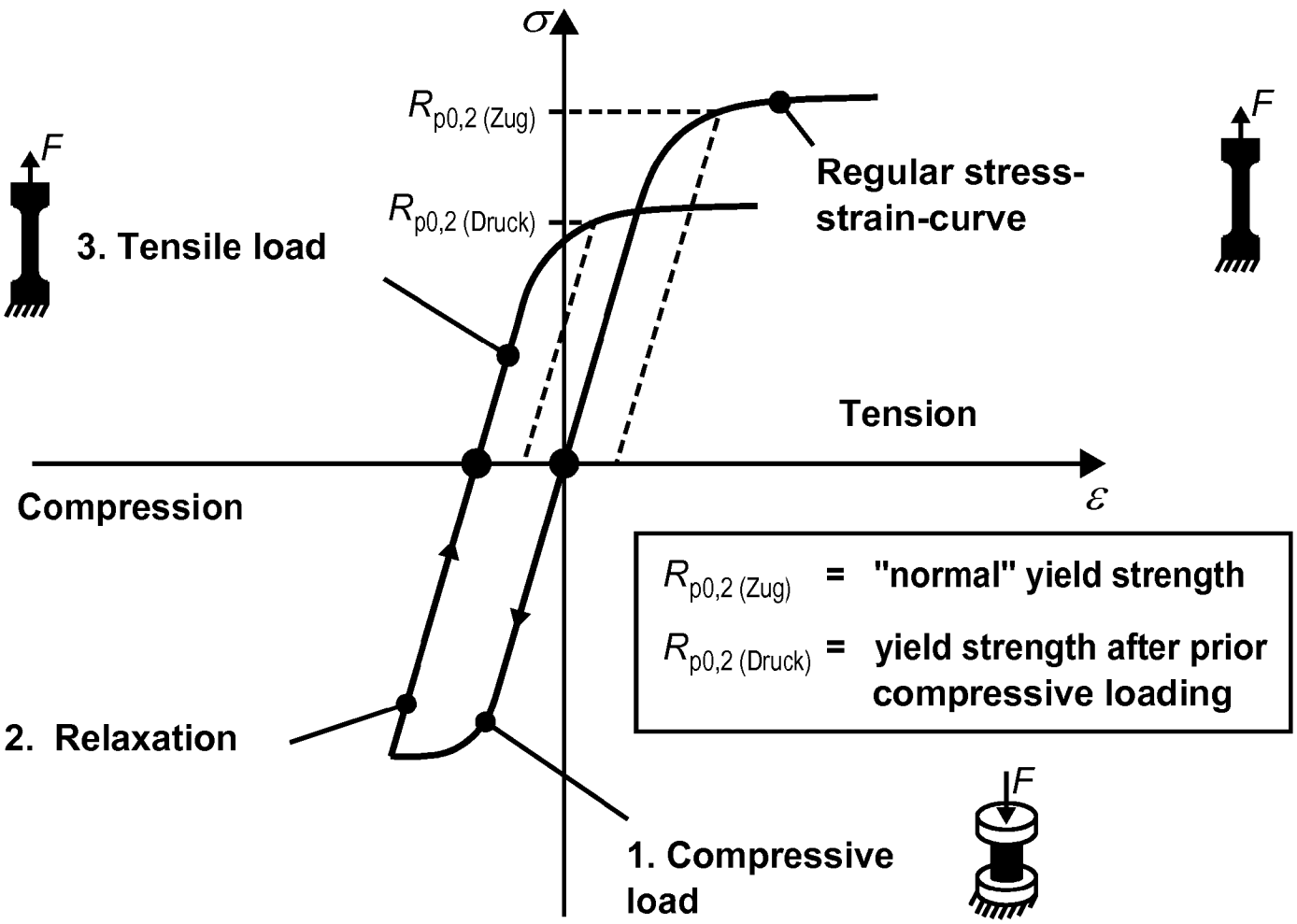
FIG. 4 is a graphical representation of strength loss due to the Bauschinger effect.

FIG. 1 illustrates a tubular 10 being expanded about 20-30% as represented schematically by arrows 12 with arrows 14 showing the tensile stress in the wall of the tubular 10. After expansion, as shown in FIG. 2, the well fluids in the surrounding annular space can exert a compressive force as indicated by arrows 16. The well fluids create compressive circumferential stress in the wall of the tubular 10 as illustrated in FIG. 3. The Bauschinger effect is graphically illustrated in FIG. 4 as a loss of strength as indicated by the curve on the left appearing below the curve on the right in the stress/strain curve. It is this loss of strength and modulus for the expanded pipe that is known as the Bauschinger effect. The present invention seeks to recapture such loss in strength and modulus after expansion using added heat. The heat can also accelerate cement curing as will be explained below.

Figures 5, 6, 7, 8, 9, 10:
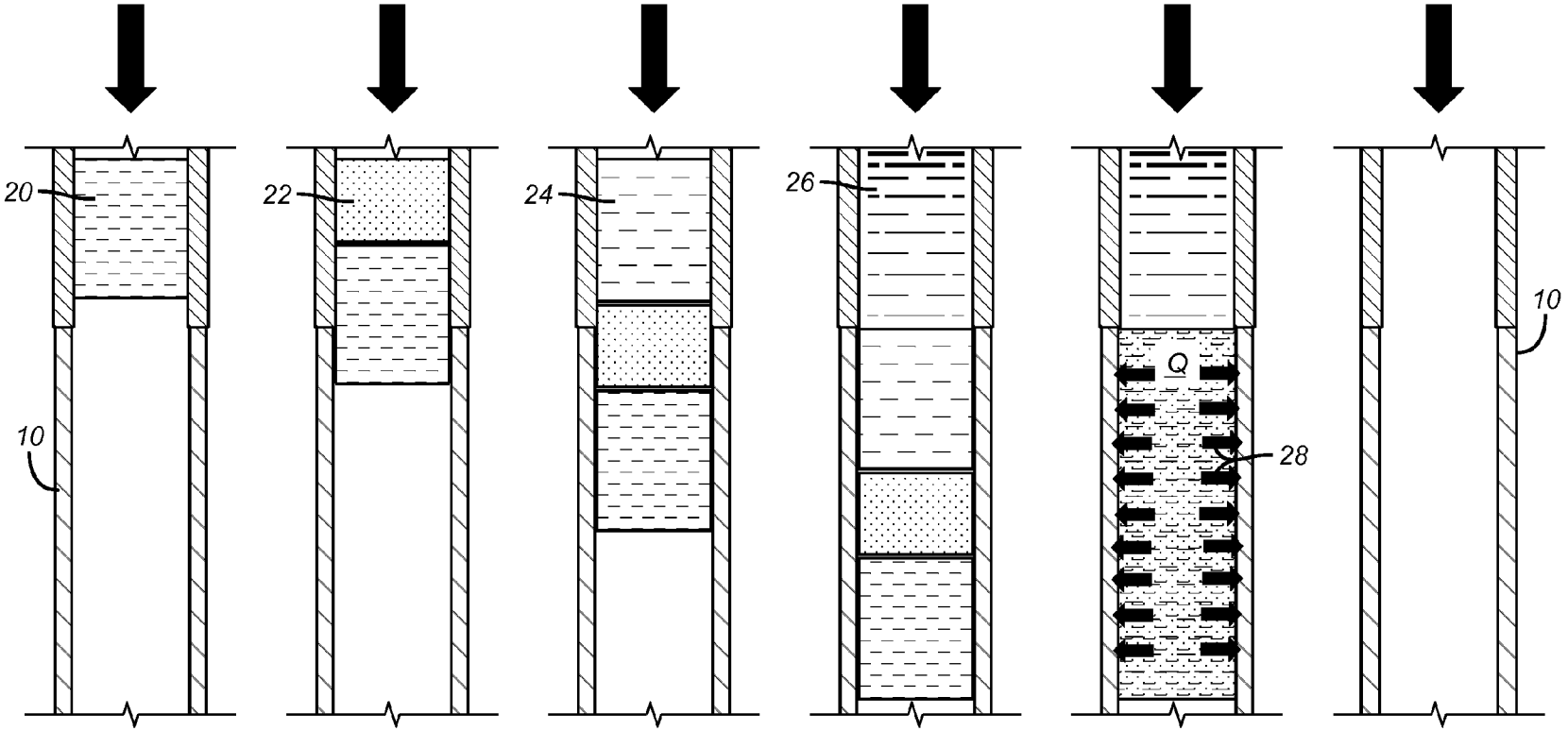
FIGS. 5-10 show a sequence for creating heat in the expanded tubular to compensate for the Bauschinger effect with initial reactant separation using a spacer between them.

Referring to FIGS. 5-10 the tubular 10 is shown in the expanded condition in FIG. 5 with the first reactant 20 such as an acid added by pumping from the surface. A spacer 22 that does not react with reactant 20 is next pumped in, followed by the other reactive ingredient 24. Drilling mud or some other non-reactive fluid 26 is pumped on top of reactant 24 to spot the reactants 20 and 24 at the desired location in the tubular string 10. FIG. 9 schematically illustrates mixing of the reactants 20 and 24 which creates an exothermic chemical reaction and gives off heat Q. Arrows 28 represent mixing through the spacer 22 which can occur from flow induced turbulence or static or dynamic inline mixers of a type known in the art. Heating to a range of about 150-300 degrees Centigrade for preferably a time of several hours is preferred for full yield strength and modulus recovery. The warmer the temperature the shorter the heating cycle can be for a full recovery of yield strength and modulus of elasticity. FIG. 10 shows the tubular 10 after the heat treating.

Figure 13:
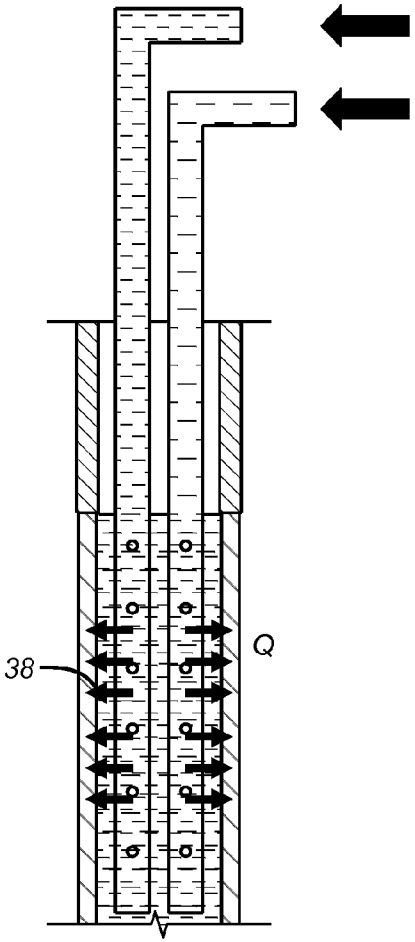
FIGS. 11-13 show a sequence of delivering reactants with individual tubular delivery pipes to initiate an exothermic reaction in the expanded tubular.
Figure 12:
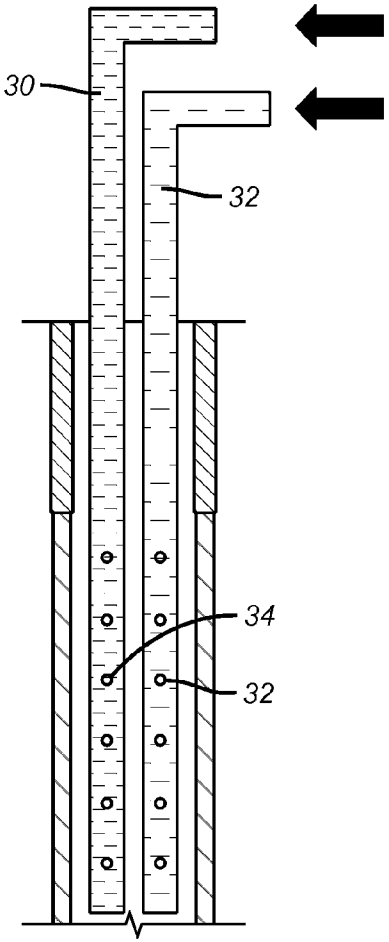
Figure 11:
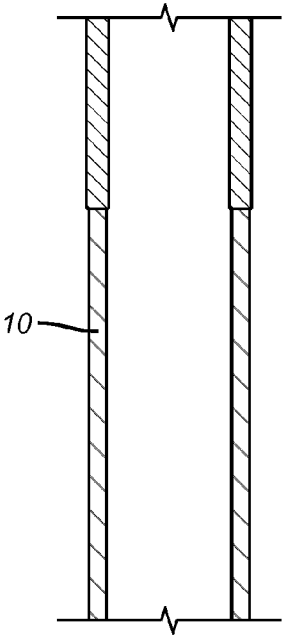
Figures 14, 15, 16, 17, 18, 19:
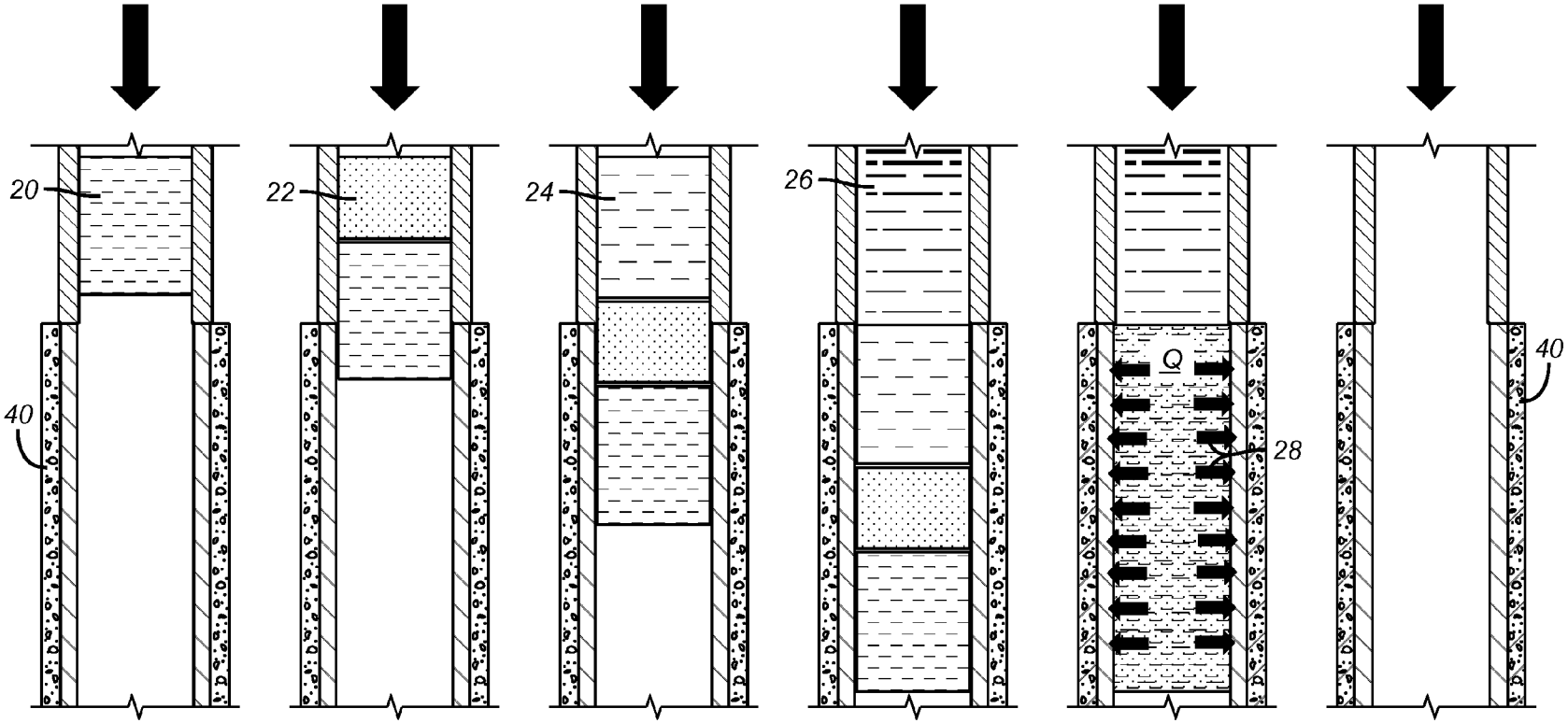
FIGS. 14-19 are similar to FIGS. 5-10 with the addition of cement in the annulus whose curing time is reduced from the heat generated in the reaction.
Figures 20, 21, 22, 23, 24, 25:
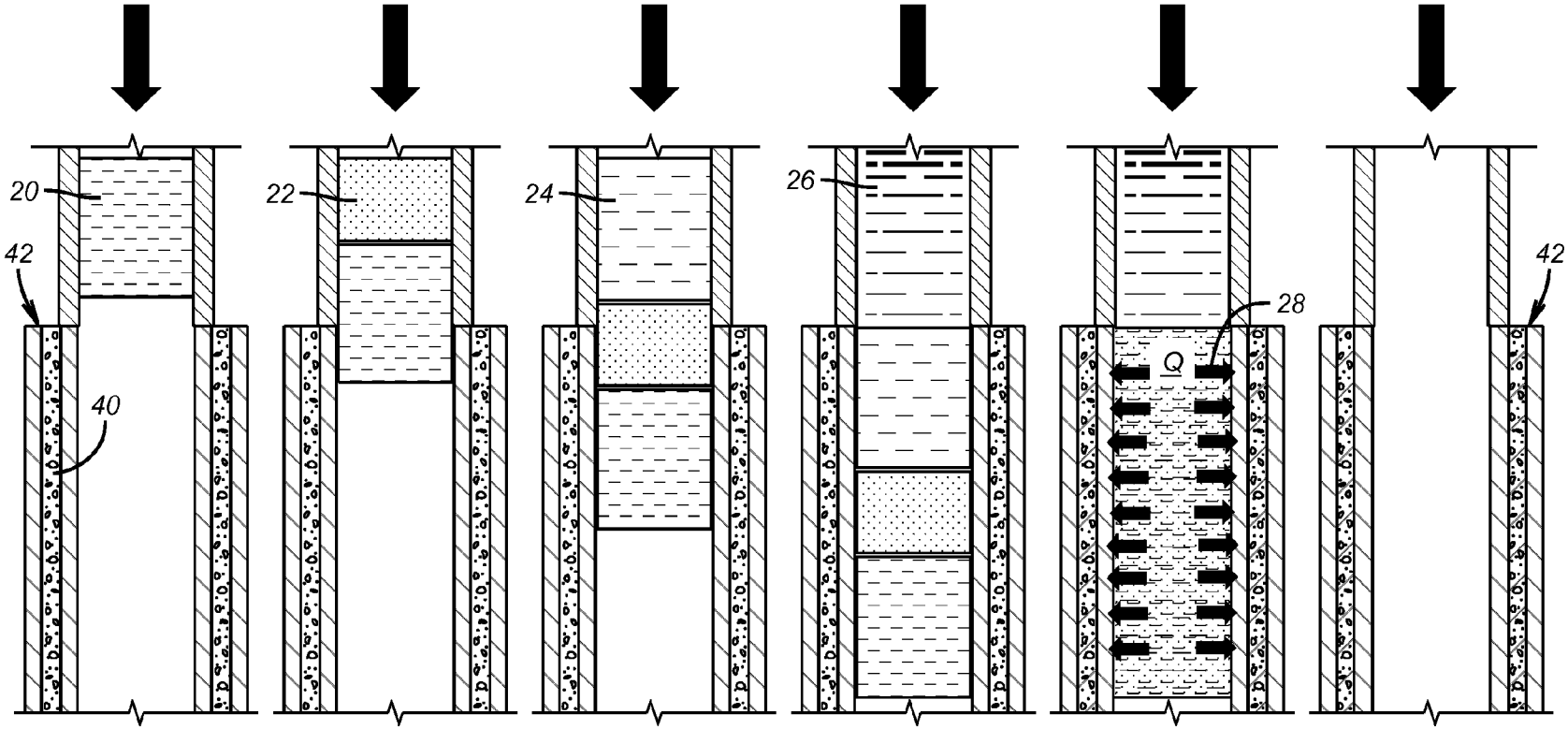

FIGS. 11-13 shows discrete delivery tubes 30 and 32 such as coiled tubing that can have perforations 34 and 36 in a random or ordered pattern and preferably near the lower end as shown in FIG. 12. Each reactant is delivered in a discrete tube and they mix in the vicinity of the openings 34 and 36. Static or dynamic inline mixers can also be deployed as schematically illustrated by arrows 38. The result is the same as explained above for FIGS. 5-10.

FIGS. 14-19 are the same as FIGS. 5-10 with the addition of cement or other thermally curing sealant 40. The result is similar to FIGS. 5-10 with the additional benefit that the cement curing is accelerated with the heat Q generated in the exothermic reaction.

FIGS. 20-25 are similar to the FIGS. 14-19 except instead of a single wall tubular 10 being cemented and expanded, a double wall string 42 with an internal cement layer 40 is expanded and cemented. String 42 is described in US Publication 2011/0114336.

Those skilled in the art will realize that the Bauschinger effect occurs in borehole construction that results in a monobore or in progressively smaller tubulars as the borehole gets deeper. The high expansion rates now used for casing in the order of 20-30% combined with the use of low alloyed steel are possible but the tubular exhibits low initial strength which is further reduced as a result of the expansion. As a result the collapse stability is decreased due to the Bauschinger effect as is the depth that the expanded tubular string can tolerate. Independently there are the time issues for the cement to set up, whether it is delivered before or after the tubular string is expanded. The present invention where heat is generated preferably with an exothermic reaction mitigates these issues by allowing strength recovery that is lost due to the Bauschinger effect either partially or totally depending on the temperature generated for the well fluids and the exposure duration.

It should be noted that the Bauschinger effect kicks in when the loading is reversed after expansion. Before expansion the tubular properties in expansion and compression loading are comparable. Due to the Bauschinger effect the compression loading capability noticeably drops by as much as 30% and possibly more depending on the degree of expansion. This effect is dependent also on the material being expanded. Presently, there are no uniform standards for measurement of the yield strength and modulus of elasticity reductions experienced during expansion of metal tubulars.

The onset of the chemical exothermic reaction can coincide with well shut in to accelerate the reaction and to attain somewhat higher overall temperatures for the well fluids. Even in situations where there is no tubular expansion, the use of the exothermic chemical reaction can be beneficial for accelerating of the curing of the cement or other sealant. In addition the availability of the heat generated in the reaction can also provide more versatility in using lower viscosity cement that will be easier to pump in an annular space already made smaller with tubular expansion. Lower cement densities can be considered which can lower the compressive stress on the expanded tubular with the shorter curing times that are made possible by the heat generation in the wellbore.

The range of times for the application of the heat can be as short as several minutes and can last several hours depending on the degree of reversal of the Bauschinger effect that is desired. Higher generated temperatures result in greater property recoveries from the losses of the Bauschinger effect with shorter exposure times.

Some reactants that are useful in creating the desired heat are discussed in US Publication 2011/0114323 and are generally acid/base reactions that have delivered temperatures in the range of 245 degrees Centigrade. Those combinations are fully incorporated herein as though actually set forth.

Also envisioned are alternative heat sources such as electric heaters, geothermal heat sources, and surface circulation systems with heating added at the surface such as boilers generating steam for heat exchangers with pumped well fluids through them, or solar heaters, to name a few examples. The well fluids can be heated in place or while there is circulation or reverse circulation as the exothermic reaction occurs.

The above description is illustrative of the preferred embodiment and many modifications may be made by those skilled in the art without departing from the invention whose scope is to be determined from the literal and equivalent scope of the claims below:

We claim:

1. A completion method, comprising:
delivering a tubular string to a predetermined subterranean location;
expanding said string;
raising the temperature of well fluid at the subterranean location to a predetermined temperature;
reversing a Bauschinger effect from said expanding with said raising the temperature;
reducing differential compressive loading on said string from formation fluids at the subterranean location during said raising the temperature.

2. The method of claim 1, comprising:
using an exothermic reaction for raising the temperature.

3. The method of claim 1, comprising:
raising said temperature after said expanding.

4. A completion method, comprising:
delivering a tubular string to a predetermined subterranean location;
expanding said string;
raising the temperature of well fluid at the subterranean location to a predetermined temperature;
reversing a Bauschinger effect from said expanding with said raising the temperature;
accelerating the curing of a sealing material with said raising the temperature.

5. The method of claim 4, comprising:
placing said sealing material in an annular space about said tubular string before or after said expanding.

6. The method of claim 5, comprising:
selecting a predetermined viscosity or density cement taking into account said raising the temperature.

7. The method of claim 5, comprising:
using cement as said sealing material;
disposing said cement between multiple walls that define said string.

8. A completion method, comprising:
delivering a tubular string to a predetermined subterranean location;
expanding said string;
raising the temperature of well fluid at the subterranean location to a predetermined temperature;
reversing a Bauschinger effect from said expanding with said raising the temperature;
using an exothermic reaction for raising the temperature;
separating reactants that react exothermically when delivering said reactants to a predetermined location in said string.

9. The method of claim 8, comprising:
pumping a spacer into said string between said reactants for said separation.

10. The method of claim 9, comprising:
mixing said reactants with a static or dynamic mixer in said string.

11. The method of claim 8, comprising:
using discrete delivery tubes to separate said reactants during delivery to the predetermined location in said string.

12. The method of claim 11, comprising:
using coiled tubing with lower end wall perforations for said discrete delivery tubes.

13. A completion method, comprising:
delivering a tubular string to a predetermined subterranean location;
sealing an annular space about said string with a sealing material whose curing rate is responsive to temperature;
raising the temperature of well fluid at the subterranean location with an exothermic reaction involving reactants other than said sealing material to a predetermined temperature to accelerate said curing.

14. The method of claim 13, comprising:
using cement as said sealing material;
disposing said cement between multiple walls that define said string.

15. A completion method, comprising:
delivering a tubular string to a predetermined subterranean location;
sealing an annular space about said string with a sealing material whose curing rate is responsive to temperature;
raising the temperature of well fluid at the subterranean location with an exothermic reaction involving reactants other than said sealing material to a predetermined temperature to accelerate said curing;
expanding said string;
using an exothermic reaction for said raising the temperature.

16. The method of claim 15, comprising:
separating reactants that react exothermically when delivering said reactants to a predetermined location in said string.

17. The method of claim 16, comprising:
pumping a spacer into said string between said reactants for said separation.

18. The method of claim 17, comprising:
mixing said reactants with a static or dynamic mixer in said string.

19. The method of claim 16, comprising:
using discrete delivery tubes to separate said reactants during delivery to the predetermined location in said string.

20. The method of claim 19, comprising:
using coiled tubing with lower end wall perforations for said discrete delivery tubes.

21. The method of claim 16, comprising:
reversing a Bauschinger effect from said expanding with said raising the temperature.

22. A completion method, comprising:
delivering a tubular string to a predetermined subterranean location;
sealing an annular space about said string with a sealing material whose curing rate is responsive to temperature;
raising the temperature of well fluid at the subterranean location with an exothermic reaction involving reactants other than said sealing material to a predetermined temperature to accelerate said curing;
expanding said tubular string;
placing said sealing material in the annular space about said tubular string before or after said expanding said tubular string.

23. A completion method, comprising:
delivering a tubular string to a predetermined subterranean location;
sealing an annular space about said string with a sealing material whose curing rate is responsive to temperature;
raising the temperature of well fluid at the subterranean location with an exothermic reaction involving reactants other than said sealing material to a predetermined temperature to accelerate said curing;

selecting a predetermined viscosity or density cement taking into account said raising the temperature.

* * * * *